US006866170B1

(12) United States Patent
Kiernan

(10) Patent No.: US 6,866,170 B1
(45) Date of Patent: Mar. 15, 2005

(54) LIQUID FLOW REGULATION DEVICE

(76) Inventor: Amy Kiernan, 365 Parrott Dr., San Mateo, CA (US) 94402

( * ) Notice: Subject to any disclaimer, the term of this patent is extended or adjusted under 35 U.S.C. 154(b) by 0 days.

(21) Appl. No.: 10/822,766

(22) Filed: Apr. 13, 2004

(51) Int. Cl.[7] ..... B65D 47/00
(52) U.S. Cl. ..... 222/547; 215/266
(58) Field of Search ..... 222/547, 564; 215/266

(56) References Cited

U.S. PATENT DOCUMENTS 3,399,811 A * 9/1968 Miller ..... 222/147
3,794,202 A * 2/1974 Unger ..... 222/500
5,743,437 A * 4/1998 Moore et al. ..... 222/547
5,988,415 A 11/1999 White
5,996,860 A * 12/1999 Alley ..... 222/564

* cited by examiner

*Primary Examiner*—Philippe Derakshani
(74) *Attorney, Agent, or Firm*—Theodore J. Bielen, Jr.

(57) ABSTRACT

A liquid flow regulation device utilizing a cage having a passageway with an exit. The passageway includes an open web portion and a closed wall portion adjacent to one another. A floating element is confined to the passageway of the cage and is buoyant in the liquid found in a bottle. The floating element is unable to travel through the exit and obstructs the flow of liquid from the bottle when positioned adjacent a spout passage.

12 Claims, 3 Drawing Sheets

LIQUID FLOW REGULATION DEVICE

BACKGROUND OF THE INVENTION

The present invention relates to a novel and useful liquid flow regulating device.

Large water bottles are often used with dispensing machines which require that the bottle be inverted prior to use. This maneuver requires a person to lift and invert the bottle into the dispensing device, the accomplishment of this task without spilling water on the area adjacent to the dispensing mechanism entails a large degree of skill.

Reference is made to U.S. Pat. No. 5,988,415 which proposed a novel and successful solution to this problem. The bottle flow controller of U.S. Pat. No. 5,988,415 utilized a cage having a floating element therewithin that temporarily shut the exit of the bottle when the bottle was being inverted, and floated free when the bottle was completely inverted to allow water to flow through the spout of the bottle.

In certain instances partially filled bottles of water are employed with water dispensing-mechanisms. When this is the case, water does not allow the ball of the bottle flow controller found in U.S. Pat. No. 5,988,415 to operate properly. This is usually due to the fact that the partially filled bottle of water has a free surface effect which creates agitation that tends to interfere with the movement of the ball within the cage of the device found in the subject patent noted above.

A fluid flow regulating device which solves the problems encountered with the flow regulators of the prior art would be a notable advance in the field of food beverages.

BRIEF SUMMARY OF THE INVENTION

In accordance with the present invention a novel and useful liquid flow regulating device is herein provided.

The device of the present invention is employed with large bottles of water having a chamber, and an aperture communicating with the chamber. The aperture permits the filling of the bottle and the egress of the liquid from the bottle when it is to be used or consumed in some manner.

The flow regulating device of the present invention employs a cage located in the aperture of the bottle. The cage defines an internal passageway which communicates with the chamber of the bottle. The cage is also provided with an exit to allow liquid to flow therefrom under appropriate conditions. Moreover the cage is provided with an open web portion and an adjacent closed wall portion. The closed wall portion includes vents.

A floating element which may be in the form of a sphere or ball, capable of floating within the passageway of the cage since is possesses buoyancy relative to the liquid in the bottle. The floating element is confined to the passageway but is able to travel therealong. At one end of its travel, the floating element is capable of obstructing the flow of liquid from the bottle when positioned adjacent the exits of the cage and adjacent the spout passage. The floating element is further capable of floating free of the exit of the passageway when the bottle is oriented in a certain position.

The closed portion of the cage prevents liquid with the bottle from contacting the ball and interfering with its travel during the tipping of the bottle from an upright position to an inverted position, where it is to be used in the liquid dispensing mechanism. Also, the closed wall portion of the cage serves as the position for a seat upon which the floating element sits to obstruct the flow of liquid from the bottle chamber. The vents are located between the seat and the exit of the cage to allow water to exit the bottle in its inverted position when the liquid within the bottle is at a low level and the floating element is inactive.

It may be apparent that a novel and useful flow regulating device has been hereinabove described.

It is therefore an object of the present invention to provide a liquid flow regulating device which is capable of preventing unwanted egress of water from a partially filled water bottle when it is being rotated from an upright position to an inverted position.

Another object of the present invention to provide a liquid flow regulating device which is capable of controlling the unwanted and desired flow of liquid from a bottle in various positions.

Another object of the present invention to provide a device for controlling the liquid flow from a bottle to prevent damage to adjacent areas relative to the liquid dispensing mechanism which is intended to hold the bottle of liquid.

Another object of the present invention to provide a liquid flow regulating device which minimizes injuries due to unwanted escape of liquid in areas surrounding a liquid dispensing mechanism holding a bottle.

Yet another object of the present invention to provide a liquid flow regulating device which is easily inserted and removed form a standard water bottle.

The invention possesses other objects and advantages especially as concerns particular characteristics and features thereof which will become apparent as the specification continues.

Figure 1:
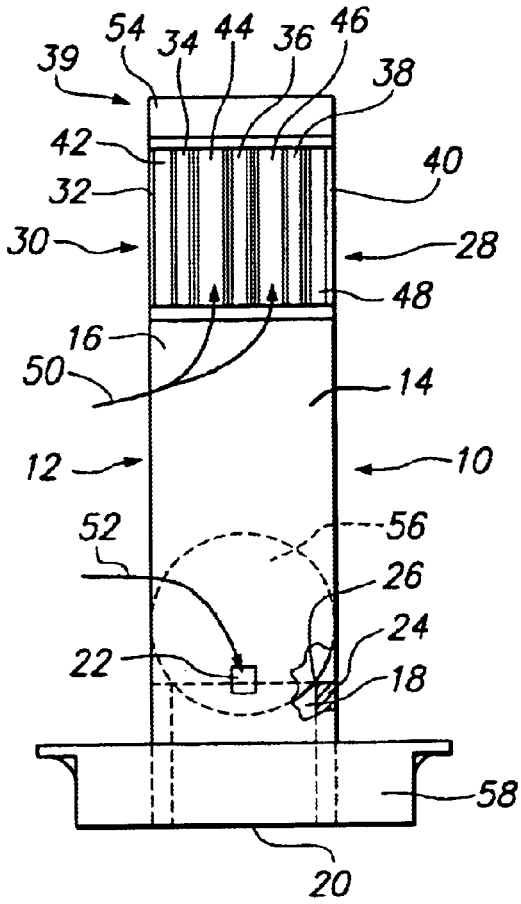
FIG. 1 is a side elevational view of the device of the present invention.

The invention possesses other objects and advantages especially as concerns particular characteristics and features thereof which will become apparent as the specification continues.

DETAILED DESCRIPTION OF THE PREFERRED EMBODIMENTS OF THE INVENTION

Various aspects of the present invention will evolve from the following detailed description of the preferred embodiments thereof which should be taken together with the herein before delineated drawings.

An embodiment of the invention as a whole is depicted in the drawings by reference character 10. The flow regulating device 10 of the present invention, FIG. 1 includes a cage 12 and includes a cylindrical member 14 having a solid wall portion 16. The internal passageway 18 extends through cylindrical body 14 and terminates in an exit 20 FIGS. 1 and 2. Vent 22 and another on the opposite side of cylindrical body 14, coincident with the opening depicting vent 22 on FIG. 1, pass through cylindrical body 14. A pedestal or bushing 24 lies within cylindrical boy 14 and provides a seat 26.

Figure 2:
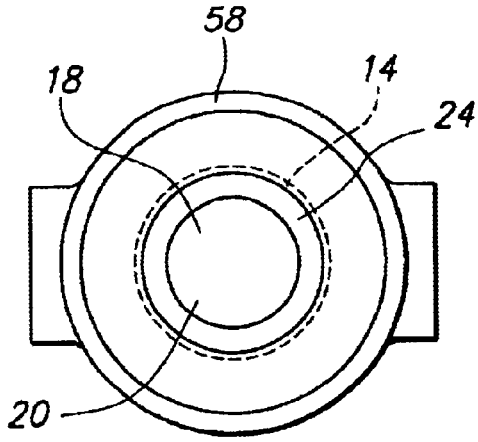
FIG. 2 is a bottom plan view of the device of the present invention.
Figure 3:
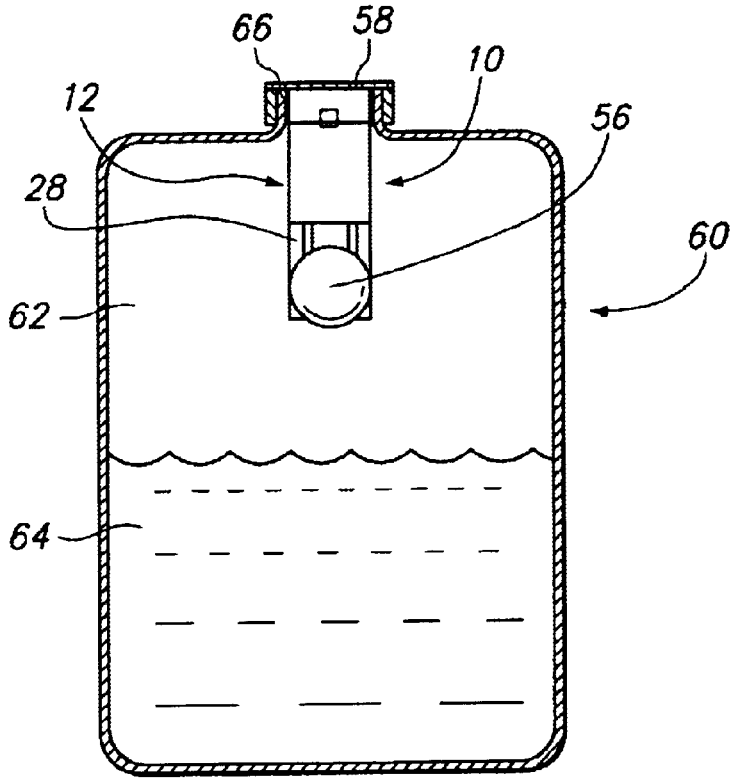
FIG. 3 is a sectional view showing the device of the present invention in a partially filled water bottle in its upright position.
Figure 4:
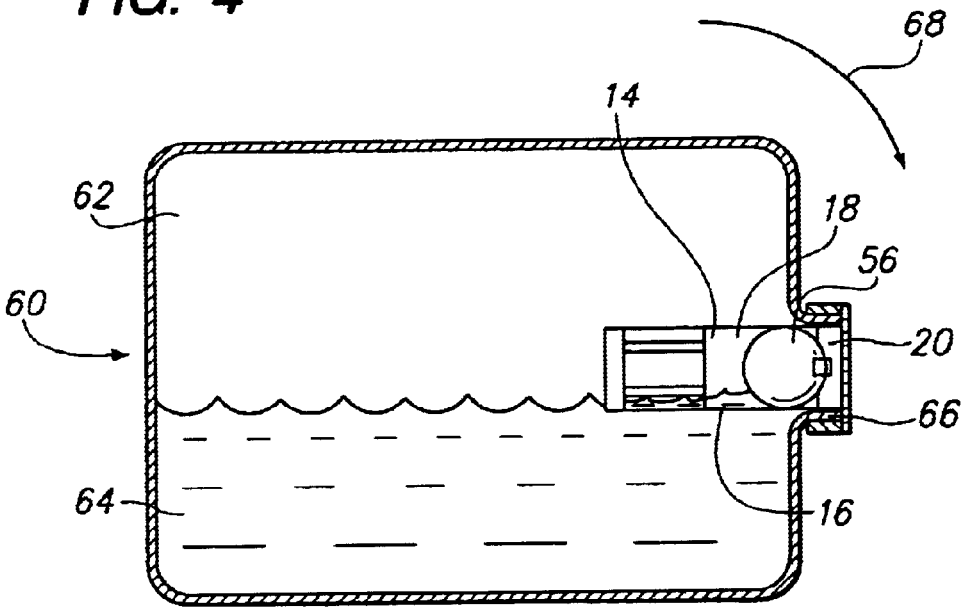
FIG. 4 is a sectional view showing the device of the present invention in place in a water bottle tipped slightly beyond 90 degrees from that depicted in FIG. 3.

Cage 12 also includes an opened web portion 28 connected to and extending from cylindrical body 14. Open web portion 28 includes a plurality of curved slats 30. Slats 32, 34, 36, 38, and 40 are depicted in FIG. 1. It should be understood that such slats extend around cylindrical open web portion 28. Thus, a plurality of openings 39 are formed such as openings 40, 42, 44, 46, and 48 to allow the passage of liquid therethrough, directional arrow 50 under certain circumstances which will be described hereinafter. It should also be noted that vent 22 also permits the passage of liquid into a portion of passageway 20, directional arrow 52. Reinforcing ring 54 forms the terminus of open web portion 28.

With further reference to FIG. 1, a floating element 56 lies within passageway 20 and is confined thereto by bushing 24 and reinforcing ring 54. Floating element 56 may take the form of a hollow ball or a sphere and is buoyant in the liquid which should be controlled by device 10 and will be described in detail hereinafter. Cap 58 attaches to cage 12 and is adapted to fit onto the spout of a typical water bottle. Of course, many fittings similar to cap 58 may be used depending on the particular geometry of any bottles used with device 10 of the present invention. In addition, cap 58 may be constructed used to fit onto other auxiliary items used in conjunction with the spouts of water bottles which are used with the present invention.

In operation, device 10 is employed according to the drawings and in particular FIGS. 3–6. A water bottle 60 is shown in FIGS. 3–6. Water bottle 60 includes a chamber 62 filled with a liquid body 64, which may be potable drinking water. Although device 10 may be used with a fully filled bottle 60, device 10 is particularly useful in a partially filled bottle, such as that depicted in FIGS. 3–6. Initially, device 10 is fitted over the end spout 66 of bottle 60 by the use of cap 58. Other structures may be used in substitution for cap 58 to accommodate the geometry of spout 66 or other mechanisms which may be used in conjunction with spout 66. As may be observed, device 10 is shown in a cutaway configuration in FIGS. 3–6. Floating element 56 initially lies in open web portion 28 of cage 12 under the force of gravity. As water bottle 60 is tilted to the position shown in FIG. 4, directional arrow 68 floating element 56 travels within passageway 18 to solid wall portion 16 of cylindrical body 14 and onto seat 26. Solid wall portion 16 prevents the interference of the movement of floating element 56 within passageway 18 by agitated water from water body 64 and directs such water into passageway 18 through open web portion 18 of cage 12. Any water is prevented from exiting the spout 66 of water bottle 60 and through exit 20 of cage 12 by a seal resulting from the contact of floating element 56 on seat 26. Thus, water is kept from spilling in the areas surrounding water bottle 60 at this point.

Figure 5:
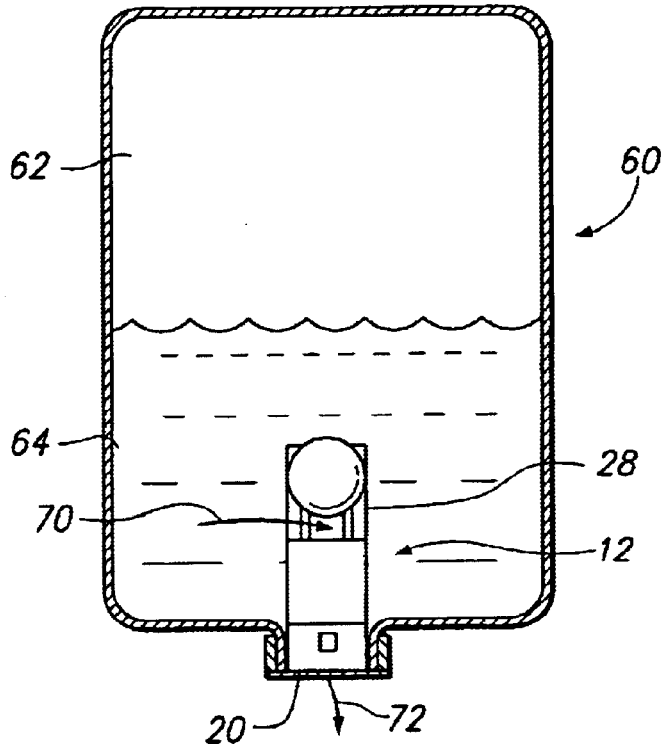
FIG. 5 is a sectional view showing the device of the present invention in place in a completely inverted water bottle.

With reference to FIG. 5, water bottle 60 has been completely inverted and water from water body 64 is free to flow through open web portion 28 of cage 12, directional arrow 70, and to pass through exit 20 of cage 12, directional arrow 72. Float element 56 has floated upwardly from seat 26 at this juncture.

Figure 6:
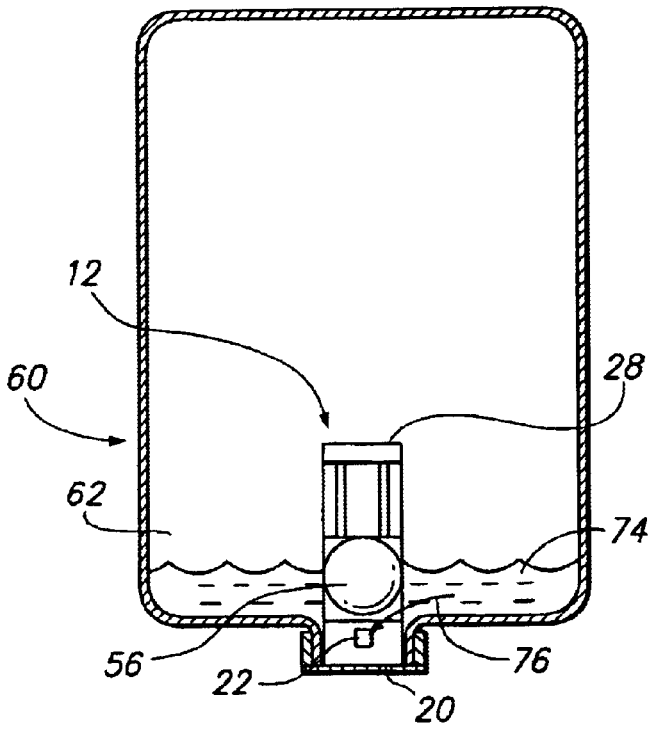
FIG. 6 is a sectional view showing the device of the present invention in place in a water bottle having an extremely low level of water.

Turning to FIG. 6 it may be observed that body of water 74 is formed within water bottle 60 due to usage of water body 64, floating element 56 travels downwardly. Consequently, water is not able to exit web portion 28 of cage 12. However, vent 22 permits the passage of water into passageway 18 and through exit 20 of cage 12, directional arrows 76. Thus, all or most of the water of water body 74 egresses water bottle 60 for consumption.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A liquid flow regulating device for a bottle having a chamber and an aperture communicating with the chamber, comprising:

a. cage located in the aperture of the bottle, said cage defining an internal passageway, communicating with the chamber of the bottle, and an exit, said cage further including an open web portion, and a closed wall portion adjacent said open web portion, said exit being located adjacent said closed wall portion;

b. a floating element, said floating element being buoyant in the liquid, said floating element further being located within the passageway of said cage to travel therealong, said floating element being formed to be unable to travel though said exit and being capable of obstructing the flow of liquid from said bottle when positioned at said cage exit adjacent the spout passage, said floating element being further capable of floating free of said exit of said passageway when the bottle is oriented in a certain position; and c. a vent located in said closed wall portion for the passage of liquid from the chamber of said bottle.

2. The device of claim 1 in which said cage further include a pedestal having a seat, said floating element being capable of engaging said seat to obstruct the flow of liquid from the bottle chamber.

3. The device of claim 1 in which said floating element engaging said seat forms a space between said seat and said exit of said cage, said vent communicating with said space.

4. The device of claim 1 in which said vent comprises a first vent and further includes at least a second vent.

5. The device of claim 4 in which said second vent communicates with said space.

6. The device of claim 1 in which said cage further comprises a stop adjacent said open web portion thereof, said stop preventing movement of said floating element in a preselected direction within said passageway of said cage.

7. The device of claim 6 in which said cage further include a pedestal having a seat, said floating element being capable of engaging said seat to obstruct the flow of liquid from the bottle chamber.

8. The device of claim 6 in which said floating element engaging said seat forms a space between said seat and said exit of said cage, said vent communicating with said space.

9. The device of claim 6 in which said vent comprises a first vent and further includes at least a second vent.

10. The device of claim 9 in which said second vent communicates with said space.

11. The device of claim 6 in which said cage further comprises a stop adjacent said open web portion thereof, said stop preventing movement of said floating element in a preselected direction within said passageway of said cage.

12. The device of claim 6 in which said floating element comprises a ball.

* * * * *